US010794573B2

(12) United States Patent
Casanova et al.

(10) Patent No.: US 10,794,573 B2
(45) Date of Patent: Oct. 6, 2020

(54) SURGE PROTECTED LUMINAIRE THAT SUPPRESSES PARASITIC CAPACITANCE

(71) Applicant: SIGNIFY HOLDING B.V., Eindhoven (NL)

(72) Inventors: Maurice Lucien Eugene Casanova, Eindhoven (NL); Mark Johannes Antonius Verhoeven, Deurne (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/634,967

(22) PCT Filed: Jul. 23, 2018

(86) PCT No.: PCT/EP2018/069864

§ 371 (c)(1),
(2) Date: Jan. 29, 2020

(87) PCT Pub. No.: WO2019/025213

PCT Pub. Date: Feb. 7, 2019

(65) Prior Publication Data

US 2020/0182440 A1 Jun. 11, 2020

(30) Foreign Application Priority Data

Jul. 31, 2017 (EP) ..... 17184012

(51) Int. Cl.
*F21S 8/08* (2006.01)
*F21V 15/01* (2006.01)
(Continued)

(52) U.S. Cl.
CPC ..... *F21V 19/003* (2013.01); *F21V 19/0005* (2013.01); *F21V 29/70* (2015.01); *H05B 45/30* (2020.01)

(58) Field of Classification Search
CPC .... F21V 19/003; F21V 29/70; F21V 19/0005; H05B 45/30
See application file for complete search history.

(56) References Cited

U.S. PATENT DOCUMENTS 9,516,720 B2 * 12/2016 Malyna ..... H05B 45/50
10,629,513 B2 * 4/2020 Woolard ..... H01L 23/3735
(Continued)

FOREIGN PATENT DOCUMENTS

EP 2837880 A1 2/2015
EP 3024302 A 5/2016
(Continued)

*Primary Examiner* — Tracie Y Green
(74) *Attorney, Agent, or Firm* — Daniel J. Piotrowski

(57) ABSTRACT

A luminaire (10) is disclosed comprising a housing (20) having a metal section (21) and incorporating an electrical component arrangement including a printed circuit board (40) having a first major surface carrying at least one light engine and a second major surface opposite the first major surface; a heatsink (30) exposed within said metal section, the heatsink having a further major surface facing the second major surface; an electrically insulating layer (50) in between the further major surface and the second major surface and having a margin (51) extending beyond each of the second major surface and the further major surface by a minimum width (W), said margin being separated from the metal section by an air gap having a minimum height (H); and at least one electrically insulating fixing arrangement (90, 100, 110) extending through the printed circuit board and the electrically insulating layer securing the printed circuit board to the metal section.

15 Claims, 6 Drawing Sheets

(51) Int. Cl.

| | |
|---|---|
| ***F21V 25/00*** | (2006.01) |
| ***F21V 19/00*** | (2006.01) |
| ***H05B 45/30*** | (2020.01) |
| ***F21V 29/70*** | (2015.01) |

(56) References Cited

U.S. PATENT DOCUMENTS

| | | | | |
|---|---|---|---|---|
| 2016/0305643 | A1* | 10/2016 | Duckworth ..... | F21V 15/01 |
| 2017/0352994 | A1* | 12/2017 | Casanova ..... | H01R 24/48 |

FOREIGN PATENT DOCUMENTS

| | | | |
|---|---|---|---|
| GB | 2492761 | A | 1/2013 |
| KR | 101059959 | B1 | 3/2011 |
| KR | 20120092843 | A | 8/2012 |
| WO | 2010112205 | A1 | 10/2010 |
| WO | 2013111037 | A2 | 8/2013 |

* cited by examiner

10

10

SURGE PROTECTED LUMINAIRE THAT SUPPRESSES PARASITIC CAPACITANCE

CROSS-REFERENCE TO PRIOR APPLICATIONS

This application is the U.S. National Phase application under 35 U.S.C. § 371 of International Application No. PCT/EP2018/069864, filed on Jul. 23, 2018, which claims the benefit of European Patent Application No. 17184012.7, filed on Jul. 31, 2017. These applications are hereby incorporated by reference herein.

FIELD OF THE INVENTION

The present invention relates to a luminaire such as a Class II luminaire comprising a housing having a metal section and incorporating an electrical component arrangement including a printed circuit board having a first major surface carrying at least one light engine and a heatsink for thermal management of the at least one light engine.

BACKGROUND OF THE INVENTION

The design of luminaires such as outdoor luminaires, e.g. street lighting, traffic lights, and so on, is typically mandated by standards to ensure that such luminaires comply with the applicable health and safety regulations. Such luminaires may be subdivided into the following classes.

Class I luminaires, which are electrically insulated and provided with a connection to earth in order to protect exposed metal parts that become live, e.g. in case of electrical insulation failure.

Class II luminaires, which are designed such that protection against electric shock does not rely on basic electrical insulation only.

Class III luminaires, for which protection against electric shock relies on the so-called supply at Safety Extra-Low Voltage (SELV) in which voltages above SELV (max. 50V AC RMS) are not generated.

Where luminaires are mounted on electrically insulating structures, e.g. wooden poles, insulating mounting wires or the like, connection to ground may not be feasible, such that Class II luminaires often are used in such circumstances, e.g. when replacing a traditional luminaire with a solid state lighting, e.g. LED-based, luminaire, for example to reduce maintenance needs for the luminaire owing to the excellent lifetime characteristics of solid state lighting-based luminaires as well as to reduce energy costs owing to the excellent energy consumption characteristics of such luminaires.

Unfortunately, many luminaires (and in particular Class II luminaires) are particularly vulnerable to common mode surges, e.g. caused by an unforeseen electrical discharge such as a lightning strike, as such surges can negatively impact the lifetime of the active circuit components, e.g. one or more driver circuits and/or one or more light engines, of the luminaire, which may become damaged by such surges such that repairs or replacement of such components may become required, which is undesirable and can be particularly cumbersome if the luminaire is mounted in a difficult to access location. Such common mode surges for example may occur due to the presence of parasitic capacitances in the luminaire. For instance, a parasitic capacitance may exist between copper tracks and the aluminium substrate of a metal core printed circuit board (MCPCB), which can provide an undesired electrical path in case of a surge event.

Therefore, there exists a need for some form of surge protection in such luminaires. However, the widely applicable luminaire standard IEC 60598-1 prevents the use of overvoltage protection devices inside a luminaire to ensure common mode protection. KR 2012/0092843 A discloses a substrate for an LED lighting device having an electromagnetic shielding function to prevent the damage of an inner lead of LEDs by discharging and bypassing electromagnetic energy through a ground pattern. This however cannot be used in Class II luminaires due to the absent ground connection in such luminaires.

Another example of class I-II luminaire is shown in EP-A-3 024 302. In this document some shunting element are used for guiding the electrical discharge to the ground.

One possible solution for surge protection of the electrical components in luminaires such as Class II luminaires is to deploy an electrically insulating material around the electrical components separating these components from the metal housing of such a luminaire. However, the thickness of such an electrically insulating envelope required to achieve the desired electrical insulation compromises the heat transfer from the heatsink coupled to the MCPCB to the outside world, thereby reducing the lifetime of the LEDs on the MCPCB due to thermal stress.

SUMMARY OF THE INVENTION

The present invention seeks to provide a luminaire, in particular a Class II luminaire, having a design that suppresses common mode surges without requiring an electrically insulating material enveloping the electrical components of such a luminaire.

According to an aspect, there is provided a luminaire comprising a housing having a metal section and incorporating an electrical component arrangement including a printed circuit board having a first major surface carrying at least one light engine and a second major surface opposite the first major surface; a heatsink exposed within said metal section, the heatsink having a further major surface facing the second major surface; an electrically insulating layer in between the further major surface and the second major surface and having a margin extending beyond each of the second major surface and the further major surface by a minimum width, said margin being separated from the metal section by an air gap having a minimum height; and at least one electrically insulating fixing arrangement extending through the printed circuit board and the electrically insulating layer securing the printed circuit board to the metal section.

The present invention is based on the insight that the heatsink for the at least one light engine, e.g. at least one LED, on the PCB may be mounted within or be integral to a metal section of the housing such that part of the heatsink, e.g. at least part of one or more cooling fins of the heatsink, extend beyond the metal section of the housing to facilitate effective cooling of the at least one light engine. At the same time, in order to safeguard the electrical component arrangement, and in particular the PCB from becoming exposed to electrical discharge events up to in the region of 12 kV such as lightning strikes, an insulating layer is located in between the heatsink and the PCB. More specifically, the inventors have found that a conductive path, e.g. a creepage current path, can be prevented from forming between the PCB and the metal section during such electrical discharge events if the surface of the heatsink facing the PCB does not extend beyond the PCB surface and the insulating layer extends beyond the PCB surface by a margin having a defined minimum width in combination with an air gap of a defined minimum height in between the margin and the metal section of the housing to suppress an electrical field strengthening effect occurring across the major surfaces of the margin.

The minimum width (W) preferably at least matches a creepage distance for a RMS working voltage of the luminaire as defined in the IEC60598-1:2014 standard as published by the International Electrotechnical Commission based in Geneva, Switzerland; see Chapter 11 of this standard. However, in order to rule out the risk of variations in environmental conditions or the like to jeopardize the electrical insulation provided by the electrically insulating layer, the minimum width of its margin may be a product of the creepage distance and a safety scaling factor having a value exceeding 1, preferably wherein said value is in the range of 2-4. For example, the safety scaling factor may be 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9 or 4.0.

Where the RMS operating voltage of the luminaire is in a range of 200-250V, e.g. is 220V, 230V or 240V, the minimum width (W) may be at least 5 mm, preferably is at least 8 mm.

To effectively suppress electrical field strengthening across the margin of the electrically insulating layer by a charge on the metal section of the housing, the minimum height (H) preferably is in a range of 1-2 mm.

In order to ensure sufficient thermal conductivity of the insulating layer, this layer preferably has a thickness of less than 1 millimeter, such as a thickness in the range of 100-400 μm. In order to maintain the desired electrical insulating properties of the insulating layer, this layer may be made of any electrically insulating material comprising a suitable dielectric constant. Examples of such materials include a polyimide film or tape such as Kapton® manufactured by the DuPont Corporation and a polyethylene terephthalate film or tape such as Melinex® manufactured by the DuPont Corporation although other materials may of course be contemplated.

In preferred embodiment, the luminaire further comprises a pair of electrical conductors connected to the electrical component arrangement for connecting the electrical component arrangement to an external power supply including a neutral (N) and live (L) terminal, wherein the metal section of the housing is shaped such that the metal section comprises a defined location having a minimal distance to the electrical conductor for connecting to the neutral terminal or the live terminal of the external power supply. Such a defined location defines a pinch point in the housing such that when the luminaire is exposed to an electrical discharge event, the associated electrical discharge can be routed to the neutral or live terminal in a controlled manner, i.e. across this pinch point, thereby avoiding or at least reducing the risk of the electrical components of the luminaire becoming exposed to undesirable common mode surges.

Typically, the electrical component arrangement comprises a driver connected to the pair of electrical conductors. In such a case, the printed circuit board may comprise a metal core having an electrically conductive connection to the electrical conductor for connecting to the neutral or live terminal of the external power supply, said connection bypassing the driver such that any surges are immediately redirected from the metal core to the live terminal, thereby bypassing the driver and the light engine(s) on the PCB.

In particularly advantageous embodiments, each fixing arrangement comprises a first component mounted in a recess within the metal section, e.g within the heatsink, and a second component secured in the first component and extending through the insulating layer and the printed circuit board, wherein at least one of the first component and the second component is made of an electrically insulating material to ensure that the fixing arrangement is electrically insulating to such an extent that the fixing arrangement does not provide a conductive path from the metal portion of the housing to the PCB during an aforementioned electrical discharge event.

The second component may have a threaded portion extending through the insulating layer and the printed circuit board, which engages with the first component in order to secure the PCB against the heatsink. Consequently, the PCB may be secured in a straightforward manner against the heatsink when assembling the luminaire. For example, the first component may be threaded such that the second component can be a screw, bolt or the like that can be screwed into the first component. Alternatively, the second component may be a threaded pin and the first component may be a body molded over the threaded pin, wherein the fixing arrangement further comprising a locking nut engaging with the threaded pin.

For mechanical stability, it is preferred that the second component is made of a metal, in which case the first component must be made of an electrically insulating material such as a plastics material in order to ensure the electrical insulation of the fixing arrangement. Alternatively, the second component may be made of an electrically insulating material, e.g. a plastic second component optionally reinforced with a rigid core of an electrically insulating material such as a glass core, in which case the first component may be made of an electrically insulating material or an electrically conductive material. For example, in such an arrangement the first component may form an integral part of the metal section of the housing, e.g. of the heatsink.

In some embodiments, the first component has an end surface facing the metal section of the housing, wherein a clearance is present between said end surface and the metal section. Such a clearance introduces a weak spot in terms of electrical breakdown, such that when a surge event occurs this weak spot will break down before any of the other insulating materials, thereby protecting these materials from degradation.

The first component may further comprise a contact surface facing the insulating layer, said contact surface comprising a deformable portion contacting the insulating layer. This ensures that upon pressing the first component against the insulating layer, a gas-tight insulating junction is formed between the first component and the electrically insulating layer such that the first component and the electrically insulating layer act as a single electrically insulating structure, which further reduces the risk of an electrical discharge event to which the housing is exposed reaching the PCB and connected electrical components through the electrically insulating layer.

Each recess may comprise a ribbed surface and/or a T-shape for securing the first component in the recess to increase friction between the first component and the recess, thereby reducing the risk that the first component is accidentally released from the recess during normal use of the luminaire, e.g. when the first component shrinks during temperature fluctuations to which the luminaire may be exposed during such normal use.

The luminaire may further comprise a lens plate covering the at least one light engine on the first major surface of the printed circuit board, wherein the at least one electrically insulating fixing arrangement further extends through the lens plate. Such a lens plate for instance may be present where the at least one light engine comprises one or more LEDs in order to shape the luminous output of such LEDs, as is well-known per se.

The housing of the luminaire may have any suitable shape. For example, the housing may comprise a metal section cooperating with a plastic or glass component defining a light exit window of the luminaire, which component may be fitted to the metal section in any suitable manner, e.g. hinged to allow access to the internals of the luminaire. Alternatively, the metal section may envelop the electrical component arrangement and include a rim defining a light exit aperture facing the at least one light engine, said rim being spatially separated from the second major surface of the printed circuit board by a distance of at least 10 millimeters in order to prevent a current discharge path forming from the rim to the PCB during exposure of the metal section of the housing to an electrical discharge event such as a lightning strike.

In an embodiment, an optically transmissive plate is mounted in said light exit aperture, such as a transparent glass plate, lens plate, diffuser plate, and so on to weatherproof the internals of the luminaire and optionally to further shape the luminous output of the luminaire. Alternatively, such an optically transmissive plate may be omitted, e.g. where a lens plate is present over the at least one light engine on the PCB, in which case the luminaire may further comprise a weatherproof seal such as a rubber seal extending from the rim to weatherproof the electrical component arrangement of the luminaire.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
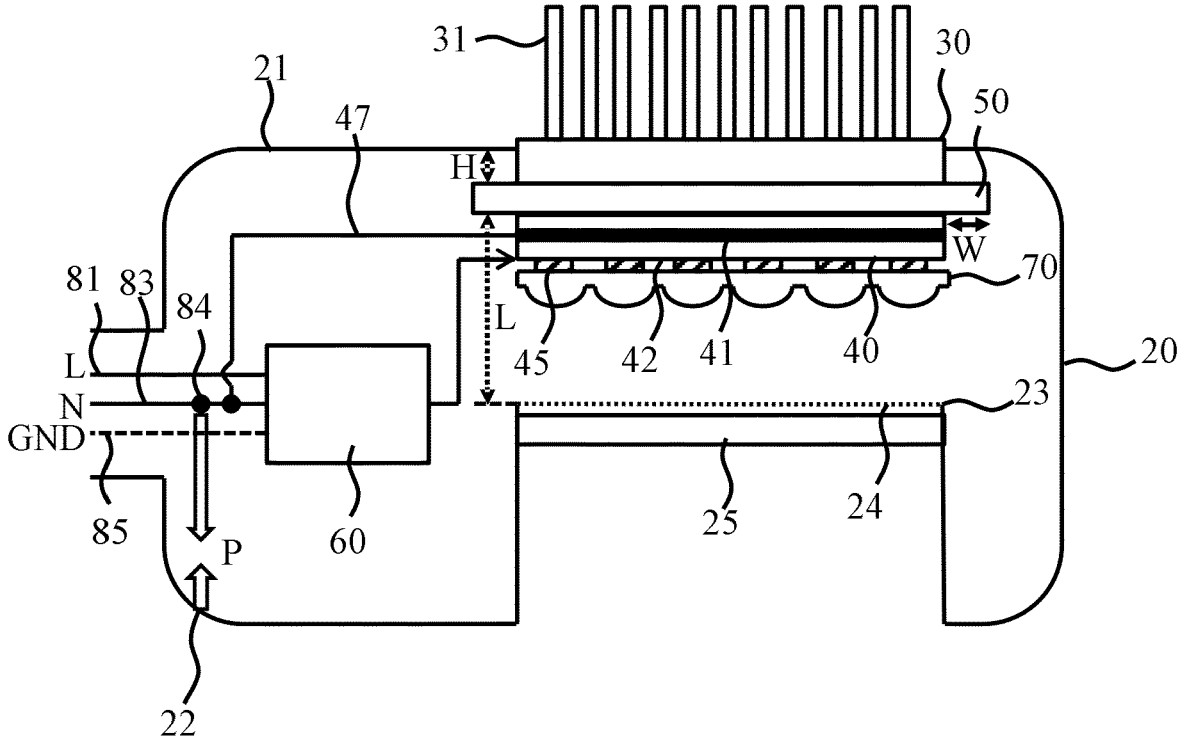
FIG. 1 schematically depicts a cross-sectional view of a luminaire according to an exemplary embodiment.

It should be understood that the Figures are merely schematic and are not drawn to scale. It should also be understood that the same reference numerals are used throughout the Figures to indicate the same or similar parts.

In the context of the present application, where reference is made to a metal, this is to be understood as a material exhibiting metallic properties in terms of electrical conductance and as such is not limited to materials consisting of elemental metals, but may also include metal alloys such as steel, bronze, brass and so on, as well as metal composites such as metal matrix composite materials.

The present application, where reference is made to a luminaire it should be understood that this may be a luminaire for any suitable application, e.g. an indoor or outdoor application, although in preferred embodiments the luminaire is designed for outdoor use. The disclosed luminaires may be any Class, e.g. Class I, Class II, Class III luminaires although in preferred embodiments the luminaire is a Class II luminaire, which as explained above tends not to be connected to ground and as such requires a regulated connection to the neutral terminal of a power supply for management of common mode surges to which the luminaire is exposed.

FIG. 1 schematically depicts a cross-sectional view of a luminaire 10 according to an exemplary embodiment of the present invention. The luminaire 10 comprises a housing 20 that is at least partially made of a metal, i.e. comprises a metal section 21. The housing 20 at least partially defines an inner chamber of the luminaire 10 in which an electrical component arrangement, i.e. an arrangement of active electrical components, is housed. The electrical component arrangement typically at least comprises a printed circuit board (PCB) 40 (or equivalent carrier) having a first major surface 42 carrying at least one light engine 45 for the generation of light to be emitted by the luminaire 10. The at least one light engine 45 in example embodiments comprises one or more LEDs spatially distributed across the first major surface 42 of the PCB 40, with each light engine 45 comprising one or more LEDs, e.g. a cluster of LEDs per individual light engine 45. Any suitable type of LEDs may be used for this purpose. It should furthermore be understood that the LEDs are not necessarily identical; it is for example equally feasible that the one or more light engines 45 comprise different types of LEDs, e.g. LEDs producing a luminous output having different spectral compositions such as different coloured luminous outputs or white light luminous outputs having different colour temperatures, in which case such a different LEDs may be individually controllable to control the spectral composition of the luminous output of the luminaire 10.

An optical structure such as a lens plate 70 may be mounted over the first major surface 42 of the PCB 40 to shape the luminous output of the at least one light engine 45 on this surface, as is well-known per se. Such a lens plate 70 may be made of any suitable material, e.g. an optical grade polymer such as polycarbonate, polyethylene terephthalate, poly (methyl methacrylate) and so on, glass, etcetera, and may implement any suitable lens function. Such a lens plate 70 in example embodiments may be used to convert a Lambertian luminous distribution produced by one or more LEDs into a different luminous distribution such as a Gaussian luminous distribution although it will be understood by the skilled person that such a lens plate may implement a virtually endless number of different optical functions including optical functions in which a non-symmetrical luminous distribution is produced to generate different luminous intensities in different regions illuminated by the luminaire 10, as for example may be required in outdoor applications such as street lighting where a road surface may be illuminated in a different manner than a pavement or other pedestrian region.

The electrical component arrangement typically further comprises a controller arrangement including a driver 60 arranged to control the at least one light engine 45 on the PCB 40. Such a controller arrangement may comprise multiple drivers as will be readily understood by the skilled person and may further comprise a wireless communication module or the like to receive wireless control instructions, e.g. from a remote controller, for controlling the luminous output of the luminaire 10, in which case the driver 60 (or multiple drivers) are typically responsive to the wireless communication module.

The electrical component arrangement, e.g. the driver 60, is typically connected to a set of electrical conductors 81, 83, 85 for connecting the electrical component arrangement to an external (mains) power supply including a first electrical conductor 81 for connecting the electrical component arrangement to the live terminal L of a mains power supply and a second electrical conductor 83 for connecting the electrical component arrangement to the neutral terminal N of a mains power supply. A third electrical conductor 85 may be present for connecting the electrical component arrangement to ground, although as previously explained such a connection may not be present or completed in case of Class II luminaires. The electrical conductors 81, 83, 85 may take any suitable shape, e.g. pins, sockets, clips, solder pads, conductive tracks and so on, or any combination thereof.

The luminaire 10 may further comprise a shielding element 41, which typically is made of an electrically conductive material, e.g. a metal, metal alloy, a conductive coating or the like, and which is arranged to shield the PCB 40 and the at the least one light engine 45 mounted thereon from being exposed to a common mode surge phenomenon such as a lightning strike hitting the luminaire 10. The shielding element 41 may be the metal core, e.g. an aluminium core, of the PCB 40 in case of the PCB 40 being a metal core PCB (MCPCB) or alternatively may be arranged on the PCB 40, e.g. as a layer substantially or entirely covering a major surface of the carrier 11.

In an embodiment, the shielding element 41 is connected to the second electrical conductor 83 through an electrically conductive connection 47 that bypasses the active circuit components, e.g. the driver 60, of the electrical component arrangement. In this manner, the shielding element 41 is connected to the neutral terminal N of the mains supply when the luminaire 10 is connected to mains. During an electrical surge event, the bypass connection 47 ensures that the electrical charge collected by the shielding element 13 substantially bypasses the active circuit components such as the driver 60, thereby protecting the active circuit components from breakdown or damage. In other words, the shielding element 41 provides equipotential bonding between the metal section 21 of the housing 20 and the mains supply, thus shielding the active circuit components within the housing 20 from surge events.

Although this principle may be applied to any type of luminaire 10 comprising one or more active circuit components, this principle is particularly advantageous in luminaires 10 comprising one or more solid state lighting elements, e.g. LEDs, as their light engines 45, as such light engines are particularly vulnerable to exposure to the short high-energy impulses associated with surge phenomena. It will furthermore be understood that such a bypass connection 47 to the neutral terminal of the mains power supply applies particularly to Class II luminaires 10. In Class I luminaires, the shielding element 41 and/or the bypass connection 47 may be omitted or connected to the third electrical conductor 85, thereby connecting the shielding element 41 to ground.

The luminaire 10 may further comprise a defined location 22 within the metal section 21 of the housing 20 at which point the metal section 21 of the housing 20 has the smallest distance between the metal section 21 of the housing 20 and a point 84 on the second electrical conductor 83 or between the shielding element 41 and the defined location 22, with all other points or locations of the metal section 21 exhibiting a greater distance to this point 84 or to the shielding element 41. For the avoidance of doubt, this refers to any distance through the luminaire 10 in which air is the dielectric medium between such a location on the metal section 21 of the housing 20 and the point 84 or the shielding element 41. This minimal distance defines a pinch point P that creates an arc discharge path between the metal section 21 of the housing 20 and the point 84 (or shielding element 41) such that upon the metal section 21 or the shielding element 41 being subjected to a sudden electrical surge, e.g. due to a nearby lighting strike or the like, the associated electrical charge is transferred from the metal section 21 to the shielding element 41 (or vice versa) across the pinch point P. In this manner, the shielding element 41 including the pinch point P acts as a lightning rod for collecting the electrical charge from the metal section 21 of the housing 20.

The arc discharge path defined by the pinch point P may have any suitable length. In example embodiments, this arc discharge path has a length of at least 6 mm. Alternatively, the arc discharge path may have a length of at least 1.6 mm in order to make the luminaire 10 compliant with the luminaire standard IEC 60598-1 for RMS mains voltages up to 150V, or the arc discharge path may have a length of at least 3 mm in order to make the luminaire 10 compliant with the luminaire standard IEC 60598-1 for RMS mains voltages up to 250V. It should be understood that other clearance dimensions for the pinch point P may be applied without departing from the teachings of the present invention, e.g. a clearance dimension as mandated by the aforementioned standard. In particular, the pinch point P may have any dimension that corresponds to a minimum clearance dimension as mandated by a relevant luminaire standard. The pinch point P preferably is located within a part of the housing in which the pinch point P does not interfere with active components, optical components and/or plastics components of the luminaire 10 such that any plasma, e.g. metal vapor, that is generated during an arc discharge event across the pinch point P does not significantly contaminate such components.

The luminaire 10 further comprises a heatsink 30 within the metal section 21 of the housing 20 thermally coupled to the PCB 40 in order to provide thermal management (cooling) of the at least one light engine 45 mounted on the first major surface 42 of the PCB 40. In a first set of embodiments, the heatsink 30 forms an integral part of the metal section 21 of the housing 20 although in alternative embodiments the heatsink 30 is a discrete component mounted in the metal section 21 of the housing 20, in which case the metal section 21 of the housing 20 may comprise a recess or the like in which the heatsink 30 is mounted in any suitable manner. At least a portion 31 of the heatsink 30, e.g. the cooling fins of the heatsink 30 extend beyond the metal section 21 of the housing 20 in a direction away from the PCB 40, i.e. stands proud of the metal section 21 to provide effective cooling of the at least one light engine 45 on the PCB 40.

The heatsink 30 is typically made of a metal in order to ensure good thermal conductivity of the heatsink 30. Consequently, the PCB 40 needs to be protected from common mode surge events to which the metal section 21 including the heatsink 30 are exposed. For this reason, an insulating layer 50 is located in between the heatsink 30 and the PCB 40. This arrangement will be explained in more detail below with the aid of FIG. 3. The PCB 40 and, if present, the lens plate 70, are affixed to the heatsink 30 or an adjacent region of the metal section 21 of the housing 20 by at least one electrically insulating fixing arrangement extending through the PCB 40 (and the lens plate 70 if present) as well as through the electrically insulating layer 50. The at least one electrically insulating fixing arrangement ensures that when the metal section 21 of the housing 20 such as the heatsink 30 is exposed to a common mode surge event, this surge cannot travel through the fixing arrangement and reach the PCB 40 in this manner. The at least one electrically insulating fixing arrangement is not shown in FIG. 1 for the sake of clarity only but example embodiments thereof will be explained in further detail with the aid of FIG. 4-6.

The metal section 21 of the housing 20 may substantially envelop the electrical component arrangement within the housing 20, i.e. the housing 20 may be substantially formed by the metal section 21. In such embodiments, the metal section 21 may comprise a rim 23 delimiting the light exit aperture 24 in the housing 20 opposite the first major surface 42 of the PCB 40 such that the light generated by the at least one light engine 45 on the PCB 40 can exit the luminaire 10 through the aperture 24. In order to avoid the creation of an arc discharge path between the rim 23 of the metal section 21 of the housing 20 and the PCB 40, the rim 23 preferably is spaced apart by at least 10 mm and more preferably by at least 13 mm from the interface between the PCB 40 and the electrically insulating layer 50, i.e. from the second major surface 44 of the PCB 40, which will be described in further detail below with the aid of FIG. 3.

As schematically depicted in FIG. 1, an optically transmissive plate 25 may be mounted in the aperture 24 in order to prevent access to the internals of the luminaire 10 through the aperture 24. Such an optically transmissive plate 25 may be a transparent plate made of any suitable optically transparent material such as an optically transparent polymer or glass, or alternatively may implement an optical function such as a lens function, a diffuser function, and so on. Where the optically transmissive plate 25 implements a lens function, such a lens function may be combined with the lens plate 70 or alternatively the lens plate 70 may be omitted from the luminaire 10. The optically transmissive plate 25 may be mounted to the rim 23 of the metal section 21 in any suitable manner, e.g. using a rubber seal or the like to weatherproof the aperture 24.

Figure 2:
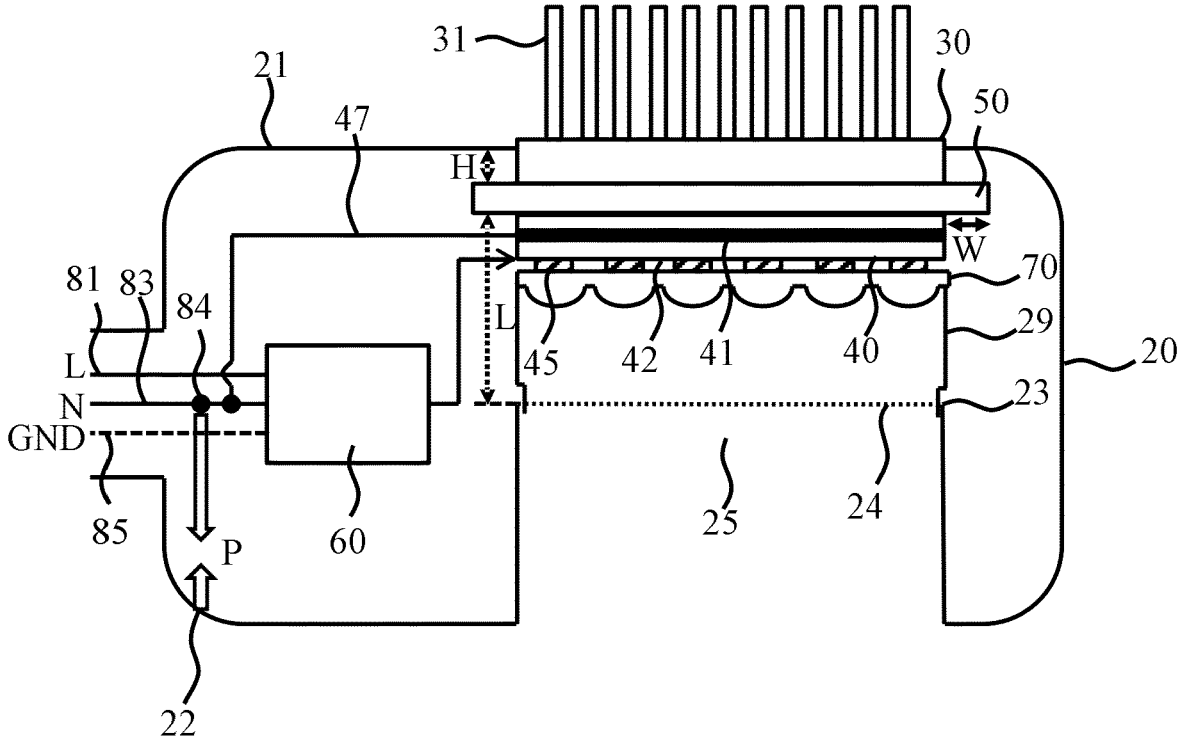
FIG. 2 schematically depicts a cross-sectional view of a luminaire according to another exemplary embodiment.

Alternatively, as schematically depicted in FIG. 2, the optically transmissive plate 24 may be omitted from the luminaire 10 in which case the luminaire 10 may further comprise a weatherproof seal 29 extending from the rim 23 to weatherproof the internals of the luminaire 10, e.g. by extending between the rim 23 and the lens plate 70. In such an embodiment, the presence of the lens plate 70 ensures that direct contact of live parts, e.g. the one or more light engines 45 on the PCB 40, is prevented.

However, it is reiterated that the housing 20 may have any suitable shape and may for example comprise a metal section 21 as well as one or more further sections at least some of which are interfacing with the metal section 21, such as for example an optically transmissive further section that may be optically transparent or may be diffusive and/or may comprise one or more optical elements, e.g. lenses, collimators or the like, in order to shape the luminous output produced by the light engine(s) 45 within the housing 20 of the luminaire 10. Such a further section may be secured against the metal section 21 in any suitable manner, e.g. using fasteners such as screws, clips, or the like. The further section may be partially attached to the metal section 21, e.g. by a hinge mechanism allowing the further section to swivel or swing open for access to the internals of the luminaire 10. A watertight seal (not shown) such as a rubber seal may be present between the metal section 21 and the further section to prevent water ingress into the luminaire 10, which is particularly desirable in case of the luminaire 10 being intended for outdoor use. Many other design variations of the housing 20 will be immediately apparent to the skilled person and it should be understood that the housing 20 is not limited to any of the examples explicitly described in the present application.

Figure 3:
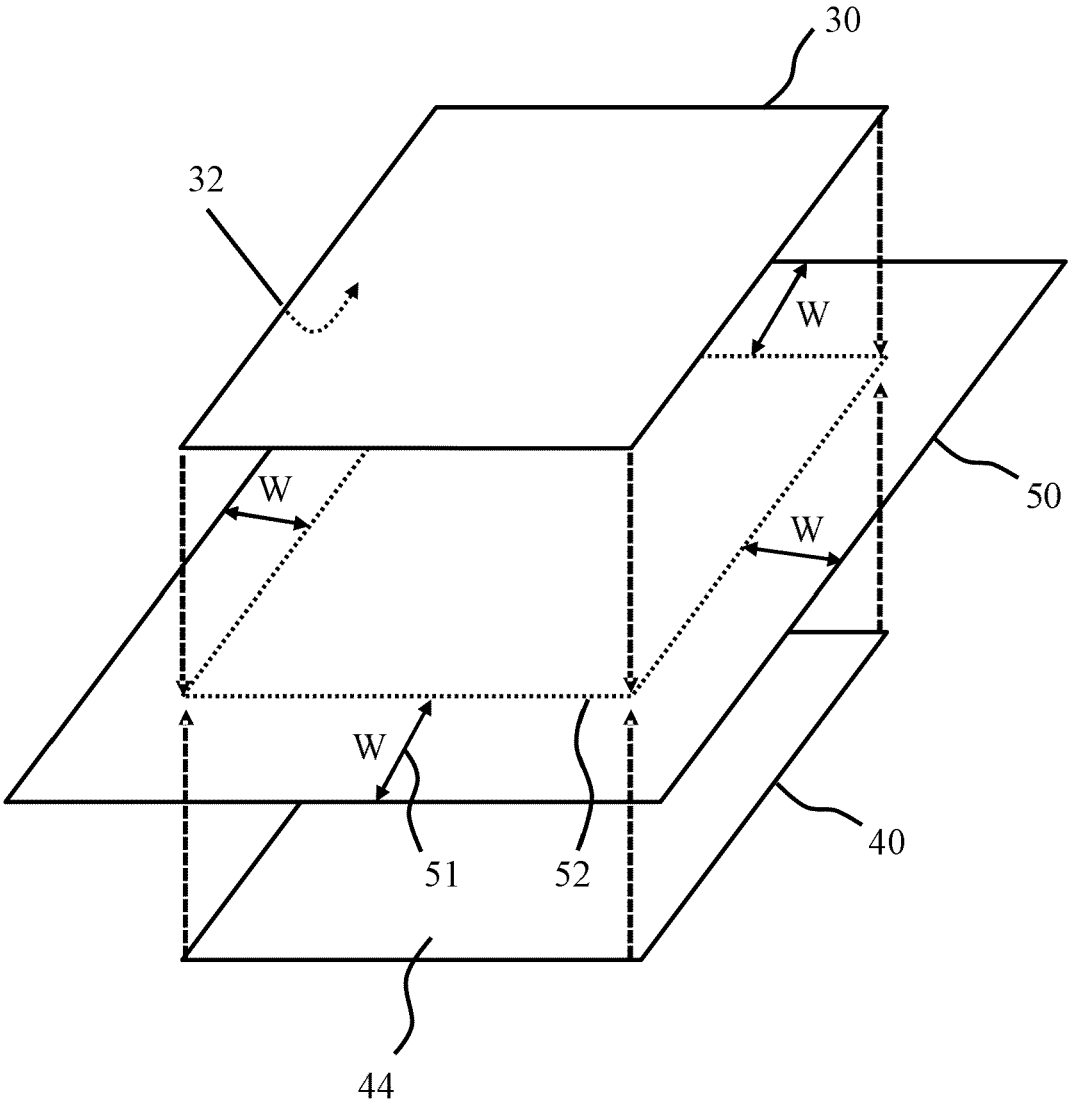
FIG. 3 schematically depicts a perspective view of an aspect of the luminaire according to embodiments of the present invention.

FIG. 3 schematically depicts a perspective exploded view of the stack including the heatsink 30, the electrically insulating layer 50 and the PCB 40 according to embodiments of the present invention. The heatsink 30 has a major surface 32 contacting a major surface of the electrically insulating layer 50 in a contact region 52 as indicated by the dashed arrows from the corners of the major surface 32 towards the contact region 52. The second major surface 44 of the PCB 40 (i.e. the major surface opposite the first major surface 42 carrying the at least one light engine 45) contacts the opposite major surface of the electrically insulating layer 50 in the contact region 52 as indicated by the dashed arrows from the corners of the second major surface 44 2 to the contact region 52.

In other words, the major surface 32 of the heatsink 30 and the second major surface 44 of the PCB 40 in a preferred embodiment have the same size and shape and are mounted on opposite sides of the electrically insulating layer 50 in an aligned manner such that no portion of the major surface 32 of the heatsink 30 extends beyond the perimeter of the second major surface 44 of the PCB 40 when viewed in a projection normal to the major surfaces of the electrically insulating layer 50. This ensures that there is a sufficient large portion of the electrically insulating layer 50 extending beyond these major surfaces to suppress the occurrence of creepage currents across these major surfaces during a surge event. Alternatively, the major surface 32 of the heatsink 30 may have any shape such that this major surface of the heatsink 30 can be mounted on the electrically insulating layer 50 such that no portion of the major surface 32 of the heatsink 30 extends beyond the perimeter of the second major surface 44 of the PCB 40 when viewed in a projection normal to the major surfaces of the electrically insulating layer 50.

The electrically insulating layer 50 is dimensioned such that a margin 51 having a width W extends beyond the contact region 52 with the second major surface 44 of the PCB 40. This width W may be a constant width or may be a variable width. In both scenarios, the margin 51 has a minimum width W of at least a creepage distance for a RMS working voltage of the luminaire as defined in the IEC60598-1:2014 standard as published by the International Electrotechnical Commission based in Geneva, Switzerland; see Chapter 11 of this standard, in particular Tables 11.1 and 11.2.

In order to rule out the risk of variations in environmental conditions or the like to jeopardize the electrical insulation provided by the electrically insulating layer, the minimum width of its margin may be a product of the creepage distance and a safety scaling factor having a value exceeding 1. This value preferably lies in the range of 2-4 to provide a substantial safety tolerance in excess of the recommended creepage distance. For example, the safety scaling factor may be 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9 or 4.0 although other values of course may be contemplated. Where the RMS operating voltage of the luminaire is in a range of 200-250V, e.g. is 220V, 230V or 240V, the minimum width (W) may be at least 5 mm, preferably is at least 8 mm.

This ensures that when a charge is present on the shielding element, e.g. the metal core 41, of the PCB 40, a touch current from the PCB 40 to the metal section 21 of the housing 20 formed by electrons gliding over the insulating layer 50 does not exceed 700 μA, thereby preventing a person touching the metal section 21 of the housing 20 in such a scenario from being exposed to a particularly noticeable shock. More generally speaking, where one of the major surface 32 of the heatsink 30 and the second major surface 44 of the PCB 40 is larger than the other, the margin W is defined from the larger of the two surfaces.

As the electrically insulating layer 50 can act as a thermal barrier between the PCB 40 and the heatsink 30, the electrically insulating layer 50 preferably has a thickness of less than 1 mm in order to limit its thermal resistance. In order for such an electrically insulating layer 50 to provide sufficient electrical insulation between the heatsink 30 and the PCB 40 in case of a common mode surge event, the electrically insulating layer 50 preferably is made of a material that is substantially gas-tight in order to prevent an arc discharge path forming through air within imperfections or the like throughout the electrically insulating layer 50. Instead, such an arc discharge path may form across the pinch point P as previously explained, thereby protecting the PCB 40 and the components thereon from exposure to such a surge event. Any suitable electrically insulating material may be contemplated for the electrically insulating layer 50. Non-limiting examples of such suitable materials include a polyimide film or tape such as Kapton® manufactured by the DuPont Corporation and a polyethylene terephthalate film or tape such as Melinex® manufactured by the DuPont Corporation, which have the advantage that sufficient electrical insulation against common mode surge events up to about 12 kV can be achieved with the layer thickness of the electrically insulating layer 50 made of such materials in the range of 100-400 μm although other materials may of course be contemplated. The electrically insulating layer 50 preferably is made of a rigid material, such that the margin 51 substantially retains its shape. However, some warping or sagging of the electrically insulating layer 50 may occur, especially where the margin 51 includes a safety tolerance as previously explained.

However, if the margin 51 of the electrically insulating layer 50 is in physical contact with the metal section 21 of the housing 20, this metal section 21 when electrically charged can cause an electrical field strengthening effect along the margin 51, which can cause a substantial electrical current to form along this path, which clearly is undesirable. To the end, the margin 51 of the electrically insulating layer 50 is spatially separated from the metal section 21 of the housing 20 by an air hap having a height H of at least 1 mm, e.g. an air gap having a height H in the range of 1-2 mm. This effectively suppresses such electrical field strengthening effects. The air gap may be combined with other electrically insulating materials in order to from a dielectric stack for suppressing such electrical field strengthening effects, although in such a dielectric stack it is still preferred to dimension the air gap as explained above.

A particular advantage of affixing the PCB 40 against the heatsink 30 by separating the PCB 40 from the heatsink 30 by such a relatively thin electrically insulating layer 50 is that particularly effective thermal management of the at least one light engine 45 on the PCB 40 is achieved due to the fact that the heatsink 30 is not enveloped by an electrically insulating material and is at least partially exposed to the outside world, e.g. through its portion 31 extending beyond the metal section 21 of the housing 20. Nevertheless, in order to maintain the robustness of the PCB 40 against the aforementioned common mode surges, the PCB 40 including the lens plate 70 when present needs to be affixed to the heatsink 30 and/or to the metal section 21 surrounding the heatsink 30 in case of the major surface 32 of the heatsink 30 having a smaller area than the second major surface 44 of the PCB 40 using a fixing arrangement that is electrically insulating.

To this end, at least one fixing arrangement and typically a plurality of fixing arrangements is provided having a first component forming part of or being secured in a region of the heatsink 30 or a region of the metal section 21 of the housing 20 surrounding the heatsink 30 and a second component that is secured in the first component and that extends through the electrically insulating layer 50, the PCB 40 and if present the lens plate 70, with at least one of the first component and the second component being made of an electrically insulating material such as a plastics material and being dimensioned such that upon the metal section 21 being exposed to a previously described common mode surge event, the electrically insulating material prevents such a common mode surge to travel through the fixing arrangement and reaching the active components such as the at least one light engine 45 on the PCB 40 or any components electrically connected to the PCB 40. The second component may be shaped such that the second component comprises a head portion at a terminal end distal to the first component, e.g. the head of a screw or the like, which head portion engages with the first major surface 42 of the PCB 40 or with the lens plate 70 such that the PCB 40 and the lens plate 70 if present are secured against the metal section 21 of the housing 20 including the heatsink 30 or alternatively a third component such as a locking nut or the like engages with the second component in order to secure the PCB 40 and the lens plate 70 if present against the metal section 21 of the housing 20 including the heatsink 30.

Figure 4:
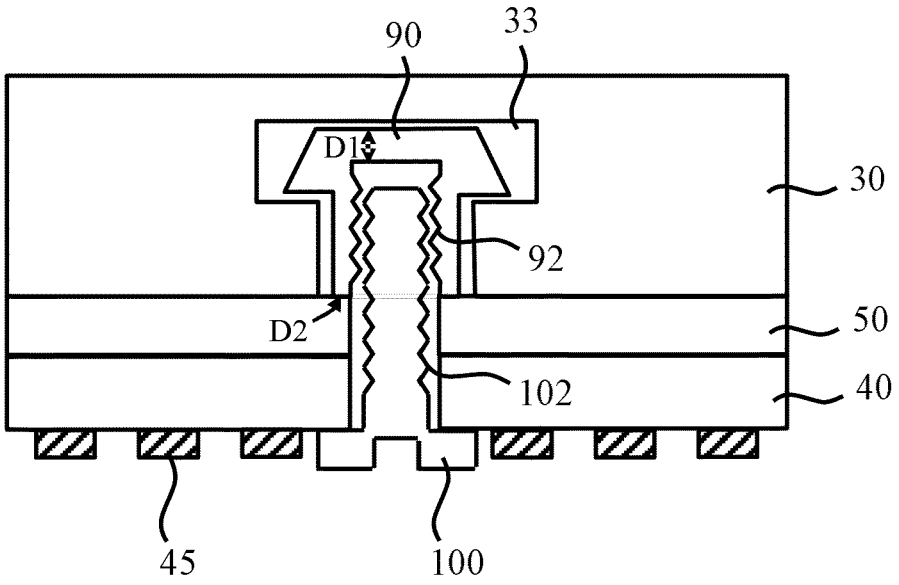
FIG. 4 schematically depicts a cross-sectional view of an aspect of a luminaire according to an example embodiment.
Figure 5:
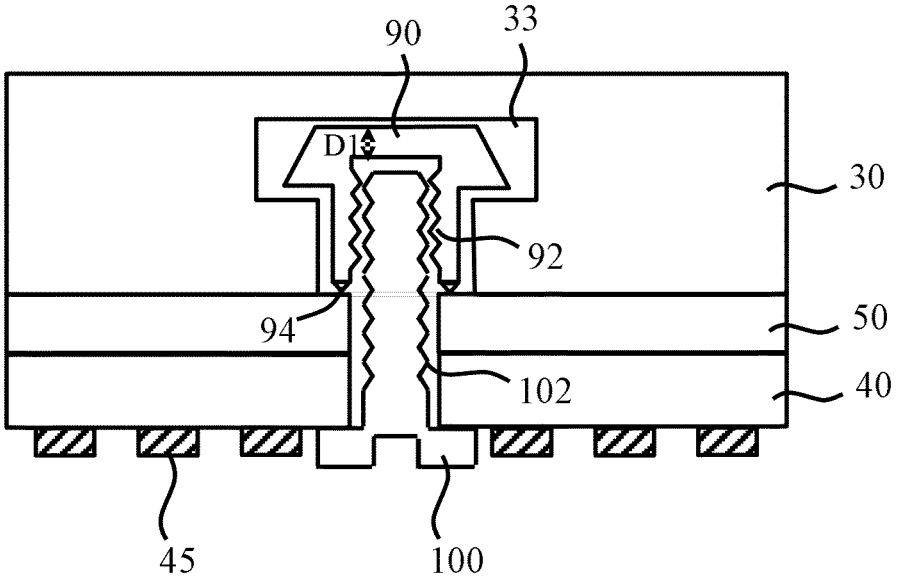
FIG. 5 schematically depicts a cross-sectional view of an aspect of a luminaire according to another example embodiment.

FIG. 4 schematically depicts a first example embodiment of such an electrically insulating fixing arrangement including a first component 90 made of an electrically insulating material such as a plastics material within a recess 33 of the heatsink 30 in this example embodiment although as previously explained the recess 33 equally may be formed in a part of the metal section 21 of the housing 20 surrounding the heatsink 30. The second component 100 in this embodiment is a metal screw that extends through the PCB 40 and the electrically insulating layer 50 and comprises a thread 102 on its outer surface that engages with a thread 92 on the inner surface of the first component 90. In this embodiment, the first component 90 is a mounting component that may be deformable in order to achieve a one-way fit in the recess 33. For example, the recess 33 and the first component 90 may generally have a T-shape or any other suitable shape that allows the first component 90 to be forcibly deformed such that the first component 90 can be inserted into the recess 33, whereas the shape of the recess 33 and the first component 90 is such that release of the first component 90 from the recess 33 is prevented as long as no considerable force is exerted on the first component 90. In this manner, it is ensured that a mechanically stable and durable fixing arrangement is provided during the lifetime of the luminaire 10.

For this reason, the second component 100, here a screw by way of non-limiting example, preferably is made of metal as a plastics screw tends to have inferior mechanical stability, especially where the luminaire 10 during use is exposed to a large temperature range which can cause excessive contraction or expansion of such a plastics screw which can cause the PCB 40 to be released from the heatsink 30 upon failure of such a fixing arrangement. However, it is well-known per se that electrically insulating fixing members such as screws with good mechanical stability can be provided, e.g. plastic screws having a reinforced core such as a glass core, and such mechanically stable electrically insulating fixing members are equally feasible, although metal fixing members are likely to be cheaper to use. Where the second component 100 is an electrically insulating component, the first component 90 may be electrically conductive and integral to the heatsink 30 or a surrounding portion of the metal section 21 of the housing 20. For example, the recess 33 in such a scenario may comprise a thread on its inner surface to secure the second component 100 in the recess 33. Instead of a screw, the second component 100 alternatively may be a pin engaging with a spring, clip or the like for securing the PCB 40 and the electrically insulating layer 50 against the heatsink 30 in the metal section 21 of the housing 20.

In case of an electrically insulating first component 90 and a metal second component 100, the portion of the first component 90 facing the upper portion of the recess 33, i.e. the portion distal to the electrically insulating layer 50, has a minimum thickness D1 of at least 1.5 mm to prevent electrical breakdown of the first component 90 during the metal section 21, e.g. the heatsink 30, being exposed to a previously described common mode surge event or when the PCB 40 becomes electrically charged, e.g. during such a common mode surge event, to prevent an electrical path forming from the PCB 40 to the housing 20 through the metal second component 100. For the same reason, the contact surface of the first component 90 with the electrically insulating layer 50 has a cross-sectional width D2 of at least 2 mm.

Such a fixing assembly may be assembled in any suitable manner. For example, the assembly process may begin by milling or otherwise forming the recess 33, after which the deformable mounting component 90 is pressed into the recess 33. Next, the stack comprising the electrically insulating layer 50 and the PCB 40 and optionally comprising the lens plate 70 is formed, which stack comprises one or more through holes aligned with one or more recesses 33. This stack is subsequently secured against the metal section 21 of the housing 20 including the heatsink 30 by extending the second components 100 through these through holes and securing them in the deformable mounting components 90 within the recesses 33.

In case the PCB 40 is a MCPCB, it may be desirable to ensure that an air path from the PCB 40 to the recess 33 along the deformable first component 90 is sealed off to further reduce the risk of the formation of an arc discharge path along such an air path. In other words, the interface between the deformable first component 90 and the electrically insulating layer 50 preferably is made substantially gas-tight. In an example embodiment schematically depicted in FIG. 5, this may be achieved by providing a deformable protrusion 94, e.g. a deformable ring or the like, which may have any suitable shape such as a tapered or pointed shape towards the electrically insulating layer 50, which deformable protrusion 94 is deformed, e.g. compressed, when the stack including the electrically insulating layer 50 and the PCB 40 (and optionally comprising the lens plate 70) is pressed against the deformable first component 90 by the second component 100 during the assembly process. It should be understood that a gas-tight arrangement between the deformable first component 90 and the electrically insulating layer 50 is not necessarily limited to this example embodiment and that such a gas-tight arrangement may be achieved in any suitable manner.

Figure 6:
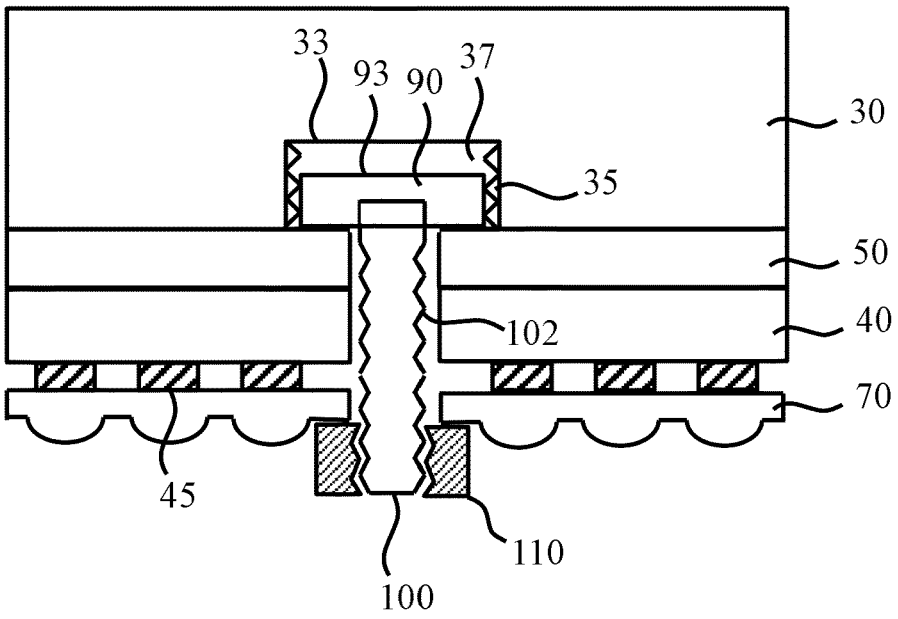
FIG. 6 schematically depicts a cross-sectional view of an aspect of a luminaire according to yet another example embodiment.

FIG. 6 schematically depicts another example embodiment of such an electrically insulating fixing arrangement including a first component 90 made of an electrically insulating material such as a plastics material within a recess 33 of the heatsink 30 in this example embodiment although as previously explained the recess 33 equally may be formed in a part of the metal section 21 of the housing 20 surrounding the heatsink 30. In this embodiment, the first component 90 is a plastics component molded over the second component 100, here a metal pin having a threaded outer surface 102, with the second component 100 extending through the aforementioned through holes in the electrically insulating layer 50, PCB 40 and lens plate 70 present in FIG. 6 by way of non-limiting example, with a threaded third component 110 such as a locking nut engaging with a portion of the threaded second component 100 distal to the first component 90 to secure this stack against the heatsink 30. It is reiterated that the second component 100 does not have to be a threaded component and instead may be designed to interact with a third component 110 in the form of a spring, clip or the like. As such fixing arrangements are well-known per se, this is not explained in further detail for the sake of brevity only.

In order to mechanically secure the overmolded first component 90 within the recess 33, the inner side surface(s) of the recess 33 may comprise one or more ribs or embossings 35 that extend into the recess 33 such that upon inserting the overmolded first component 90 into the recess 33, these ribs or embossings 35 dig into the overmolded first component 90, thereby securing this component into the recess 33. This has the further advantage that an intimate interaction between the sidewalls of the recess 33 and the overmolded first component 90 is achieved, which improves mechanical stability and reduces the risk of arc discharge path forming in between the overmolded first component 90 and the recess 33.

In an embodiment, a clearance 37 may be present in between the upper surface 93 of the overmolded first component 90 and the roof of the recess 33 to allow for expansion of the overmolded first component 90, e.g. thermal expansion or expansion resulting from water absorption by the overmolded first component 90, thereby improving the mechanical stability of the fixing arrangement of the stack including the electrically insulating layer 50, PCB 40 and optionally the lens plate 70 against the heatsink 30.

Such a fixing assembly may be assembled in any suitable manner. For example, the assembly process may begin by milling or otherwise forming the recess 33, after which the deformable mounting component 90 is molded over the second component 100 and the resulting structure is pressed into the recess 33. Next, the stack comprising the electrically insulating layer 50 and the PCB 40 and optionally comprising the lens plate 70 is formed, which stack comprises one or more through holes aligned with one or more recesses 33. This stack is subsequently secured against the metal section 21 of the housing 20 including the heatsink 30 by extending the second components 100 through these through holes and securing a third component 110 such as a locking nut by way of non-limiting example on each second component 100 as previously explained.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising:

a housing having a metal section and incorporating an electrical component arrangement including a printed circuit board having a first major surface carrying at least one light engine and a second major surface opposite the first major surface;

a heatsink exposed within said metal section, the heatsink having a further major surface facing the second major surface;

an electrically insulating layer in between the further major surface and the second major surface and having a margin extending beyond each of the second major surface and the further major surface by a minimum width (W), said margin being separated from the metal section by an air gap having a minimum height (H); and at least one electrically insulating fixing arrangement extending through the printed circuit board and the electrically insulating layer securing the printed circuit board to the metal section.

2. The luminaire of claim 1, wherein the minimum width (W) at least matches a creepage distance for a RMS working voltage of the luminaire as defined in the IEC60598-1:2014 standard.

3. The luminaire of claim 2, wherein the minimum width (W) is a product of the creepage distance and a safety scaling factor having a value exceeding 1, wherein said value is in the range of 2-4.

4. The luminaire of claim 2, wherein the minimum width (W) is at least 5 mm, is at least 8 mm when the RMS operating voltage is in a range of 200-250V.

5. The luminaire of claim 1, wherein the minimum height (H) is in a range of 1-2 mm.

6. The luminaire of claim 1, further comprising a pair of electrical conductors connected to the electrical component arrangement for connecting the electrical component arrangement to an external power supply including a neutral (N) and live (L) terminal, wherein the metal section of the housing is shaped so that the metal section comprises a defined location having a minimal distance to one of said electrical conductors.

7. The luminaire of claim 6, wherein the electrical component arrangement comprises a driver connected to the pair of electrical conductors, and wherein the printed circuit board comprises a metal core having an electrically conductive connection to one of said electrical conductors, said connection bypassing the driver.

8. The luminaire of claim 1, wherein each electrically insulating fixing arrangement comprises a first component mounted in a recess within the metal section and a second component secured in the first component and extending through the electrically insulating layer and the printed circuit board, wherein at least one of the first component and the second component is made of an electrically insulating material.

9. The luminaire of claim 8, wherein the second component has a threaded portion extending through the electrically insulating layer and the printed circuit board.

10. The luminaire of claim 9, wherein the second component is a threaded pin and the first component is a body molded over the threaded pin, each electrically insulating fixing arrangement further comprising a locking nut engaging with the threaded pin.

11. The luminaire of claim 8, wherein at least the first component is made of an electrically insulating material.

12. The luminaire of claim 11, wherein the first component has an end surface facing the metal section, and wherein a clearance is present between said end surface and the metal section.

13. The luminaire of claim 11, wherein the first component comprises a contact surface facing the electrically insulating layer, said contact surface comprising a deformable portion contacting the electrically insulating layer.

14. The luminaire of claim 8, wherein each recess comprises a ribbed surface and/or a T-shape for securing the first component in the recess.

15. The luminaire of claim 1, further comprising a lens plate covering the at least one light engine on the first major surface of the printed circuit board, wherein the at least one electrically insulating fixing arrangement further extends through the lens plate.

* * * * *